US006579111B2

(12) United States Patent
Fukamachi

(10) Patent No.: US 6,579,111 B2
(45) Date of Patent: Jun. 17, 2003

(54) SUPPORTING CONFIGURATION FOR A CONNECTOR

(75) Inventor: Makoto Fukamachi, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 09/863,283

(22) Filed: May 24, 2001

(65) Prior Publication Data

US 2001/0053623 A1 Dec. 20, 2001

(30) Foreign Application Priority Data

Jun. 8, 2000 (JP) ..... 2000-172310

(51) Int. Cl.[7] ..... H01R 13/64

(52) U.S. Cl. ..... 439/247; 439/557; 439/549; 439/544

(58) Field of Search ..... 439/246, 247, 439/259, 260, 32, 567, 571, 572, 573, 78, 85, 378, 904, 557, 549, 544

(56) References Cited

U.S. PATENT DOCUMENTS

| | | | | | |
|---|---|---|---|---|---|
| 5,071,374 | A | * | 12/1991 | Plocek et al. | 439/752 |
| 5,125,849 | A | * | 6/1992 | Briggs et al. | 439/378 |
| 5,199,900 | A | * | 4/1993 | Hayes, Sr. | 439/557 |
| 5,281,166 | A | * | 1/1994 | Yu et al. | 439/571 |
| 5,514,000 | A | * | 5/1996 | Krause et al. | 439/248 |
| 5,522,730 | A | * | 6/1996 | Soes et al. | 439/78 |
| 5,634,810 | A | * | 6/1997 | Niitsu et al. | 439/378 |
| 5,800,208 | A | * | 9/1998 | Ishizuka et al. | 439/557 |
| 5,902,149 | A | * | 5/1999 | Tashiro et al. | 439/247 |
| 5,931,688 | A | * | 8/1999 | Hasz et al. | 439/247 |
| 5,993,252 | A | * | 11/1999 | Laurx | 439/573 |
| 6,056,596 | A | * | 5/2000 | Etiembre | 439/572 |
| 6,155,857 | A | * | 12/2000 | Kato et al. | 439/248 |
| 6,210,217 | B1 | * | 4/2001 | Ping | 439/557 |
| 6,217,358 | B1 | * | 4/2001 | Norizuki et al. | 439/247 |
| 6,234,817 | B1 | * | 5/2001 | Hwang | 439/247 |
| 6,241,551 | B1 | * | 6/2001 | Watanabe | 439/350 |
| 6,315,607 | B1 | * | 11/2001 | Hwang et al. | 439/378 |
| 6,332,789 | B1 | * | 12/2001 | Okabe | 439/157 |

FOREIGN PATENT DOCUMENTS

| | | |
|---|---|---|
| JP | 8-330028 | 12/1996 |

* cited by examiner

*Primary Examiner*—Tho D. Ta
*Assistant Examiner*—Edwin A. León

(57) ABSTRACT

The invention provides a panel connector, permitted limited movement in an aperture while simultaneously preventing this connector from falling out. A female connector 20 is supported in a waiting state within a panel 10 by flanges 25 which make contact with edges of an attachment hole 11; contacting plates 52 of upper and lower pairs of resilient contacts 50, and for engagement with retaining members 12; and contacting plates 56 which engage supplementary retaining members 13. If an axis of a corresponding male connector 30 is misaligned relative to an axis of the female connector 20, some of the resilient contacts 50 bend, this causing the female connector 20 to move to align the axes of the two connectors 20 and 30. As the female connector 20 moves, the degree of engagement between some of the resilient contacts 50 is reduced. However, the reduction in this degree of engagement is compensated for by opposite edges of supplementary retaining members 13 entering, stopping grooves 58 provided in opposite supporting plates 51.

14 Claims, 8 Drawing Sheets

SUPPORTING CONFIGURATION FOR A CONNECTOR

TECHNICAL FIELD

The present invention relates to the configuration of a portion for supporting an electrical connector in a waiting state within a panel.

BACKGROUND TO THE INVENTION

One method of fitting connectors together is as follows: one of a pair of connectors is attached in a waiting state within a panel, then the corresponding connector is fitted to the waiting connector. At this juncture, the corresponding connector is attached to a separate component, and this separate component is attached to the panel, thereby fitting the corresponding connector to the waiting connector. However, due to unavoidable errors in attaching, or the like, it may happen that axes of the two connectors are not aligned, and the two connectors cannot be fitted together.

As a result, the waiting connector is often provided with a configuration which supports it, this configuration absorbing the axis misalignment and allowing fitting to take place. That is, outer faces of the connector are provided with resilient members which, when the connector is inserted into the panel, engage with an attachment hole formed in this panel. As a result, the connector is supported within the panel in a latched state, while being able to move along a plate face of this panel. Consequently, if the corresponding connector is fitted thereto with its axis being misaligned, the resilient members allow the waiting connector to move and the axes to become aligned, thus allowing the two connectors to be fitted together correctly.

This type of supporting configuration for a waiting connector is described in, for example, JP-8330028.

However, in the conventional example, when the resilient members provided on one face bend so as to align the axis, and the connector moves in one direction as these resilient members bend, the degree of engagement between the resilient members and a hole edge of the attachment hole on the opposing face decreases commensurately. Consequently, there is the problem that, when the waiting connector receives a pushing force from the corresponding connector, the engaged state of the waiting connector may be released, and it may fall out of the attachment hole.

The present invention has taken the above problem into consideration, and aims to present a supporting configuration for a connector which allows a connector whose axis needs to be aligned to be moved along a plate face of a panel while simultaneously preventing the connector from falling out of the attachment hole.

SUMMARY OF THE INVENTION

According to the invention there is provided in combination, a connector and a panel having an aperture to receive said connector with clearance, said connector having resilient external contacts for engagement with the periphery of said aperture whereby said connector is retained in said aperture for limited movement in the plane of said panel, wherein opposite sides of said connector each have a pair of said resilient contacts, each pair of resilient contacts being oppositely deformable, and said panel further comprises inward protrusions of said aperture which respectively project between associated pairs of said resilient contacts, said resilient contacts engaging opposite sides of said aperture and whereby partial disengagement of a respective resilient contact from said aperture, as a result of lateral movement of said connector in said aperture, causes a corresponding support structure to engage said protrusion by a corresponding amount.

The invention ensures that lateral movement of the connector is possible without a decrease in the security of retention. The connector is thus reliably prevented from accidental release from the panel.

Preferably each of the contacts comprise cantilevered arms having abutment faces for engagement with the periphery of the aperture on the side opposite to the direction of insertion. Inclined ribs may be provided on said arms to provide smooth and progressive bending of the arms. The ribs have the additional function of strengthening these arms.

The resilient arms are preferably provided on said support structure.

The engagement face of the contacts is preferably tapered so that resilient bending thereof increases the contact area with the panel, thus ensuring that the retention force is not reduced.

BRIEF DESCRIPTION OF DRAWINGS

Other features of the invention will be apparent from the following description of a preferred embodiment shown by way of example only with reference to the accompanying drawings.

DESCRIPTION OF PREFERRED EMBODIMENT

Figure 1:
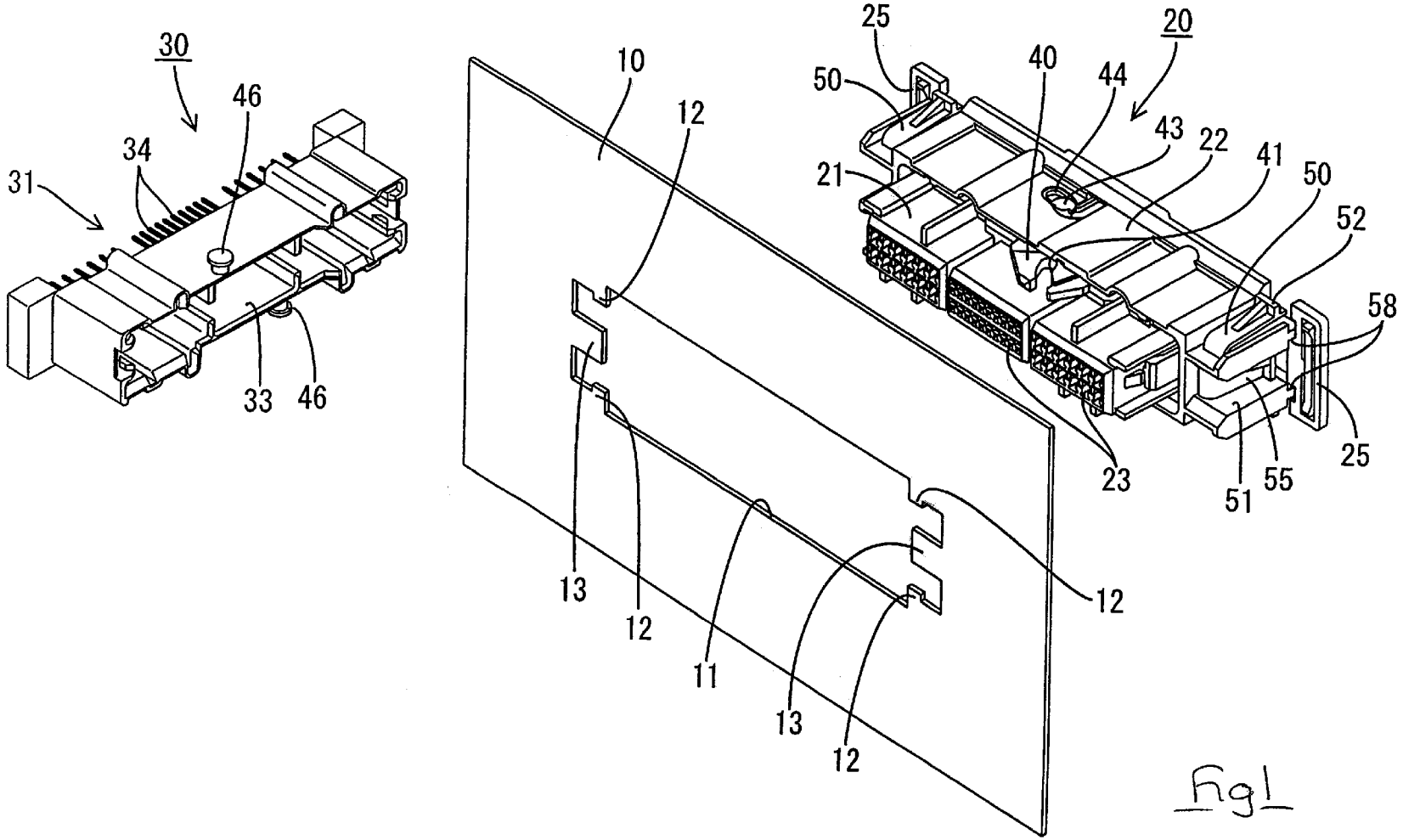
FIG. 1 is a disassembled diagonal view of an embodiment of the present invention.

An embodiment of the present invention is described below with the aid of FIGS. 1 to 9. As shown in FIG. 1, this embodiment has a female connector 20 for support in a waiting state within a panel 10. A corresponding male connector 30 is fitted to the female connector 20, the operating force for this fitting operation being augmented by levers 40.

Below, fitting face sides of the male and female connectors 20 and 30 are considered to be the anterior faces.

Figure 2:
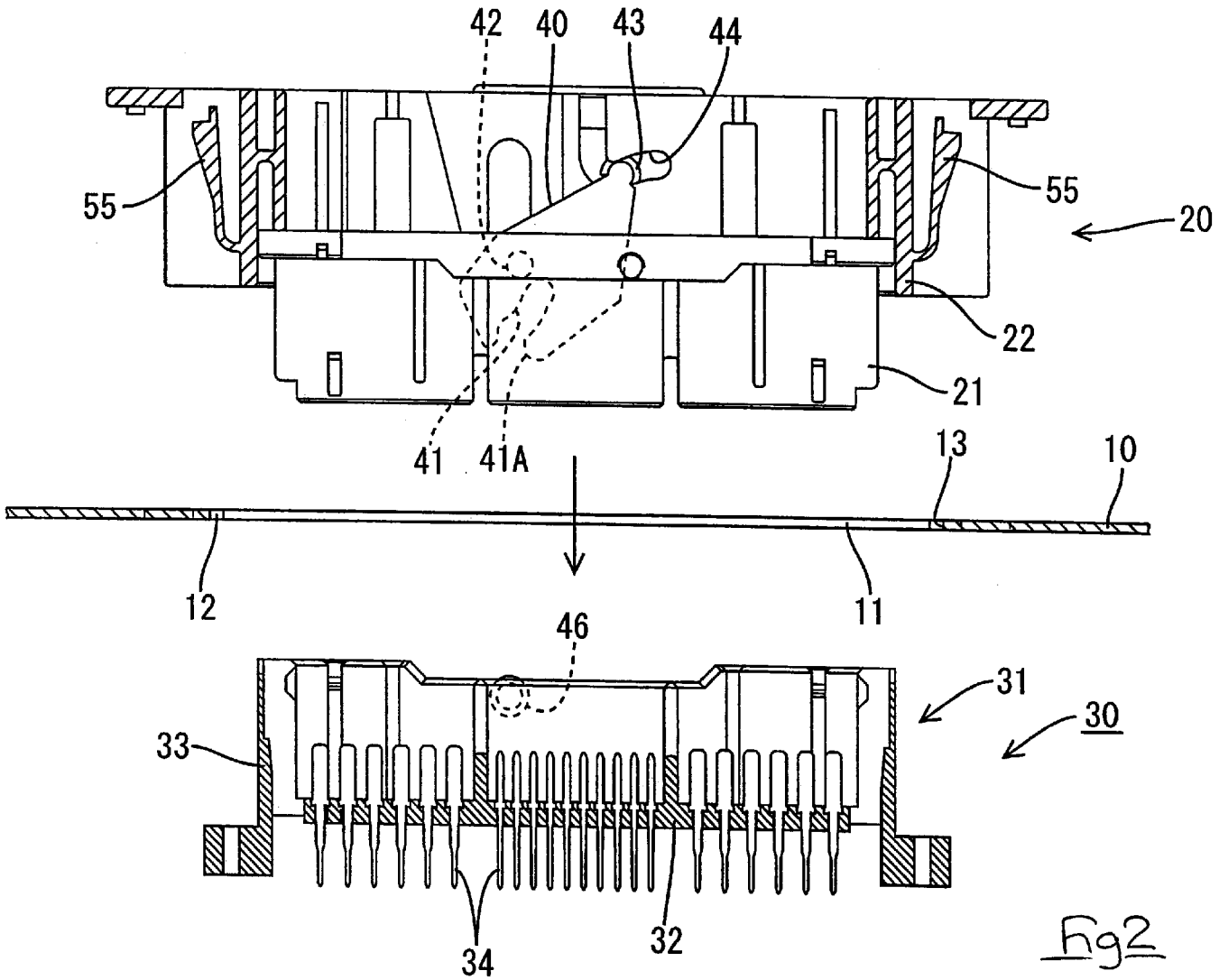
FIG. 2 is a plan cross-sectional view of the above.
Figure 3:
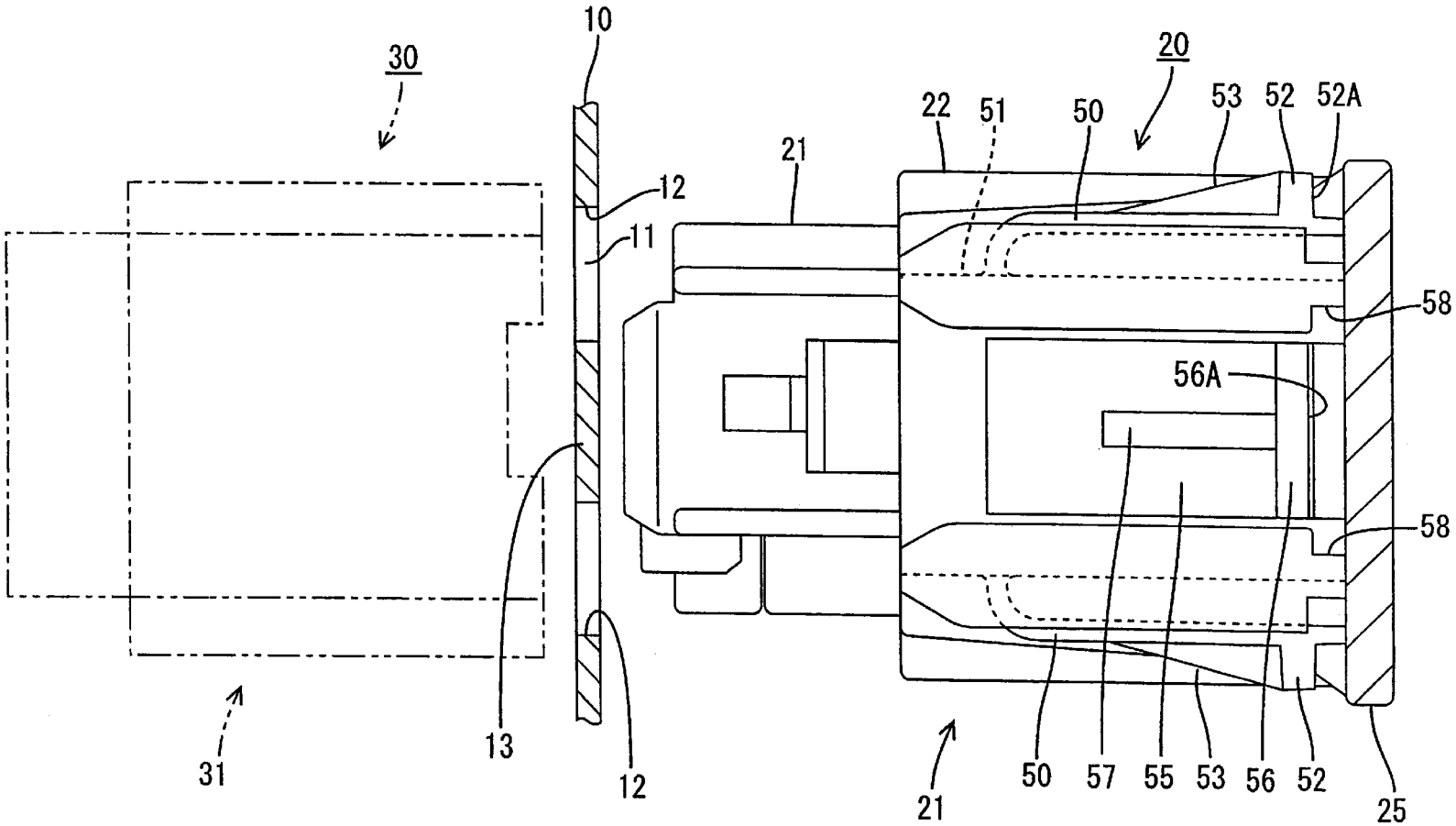
FIG. 3 is a partially cut-away side face view of the above.
Figure 5:
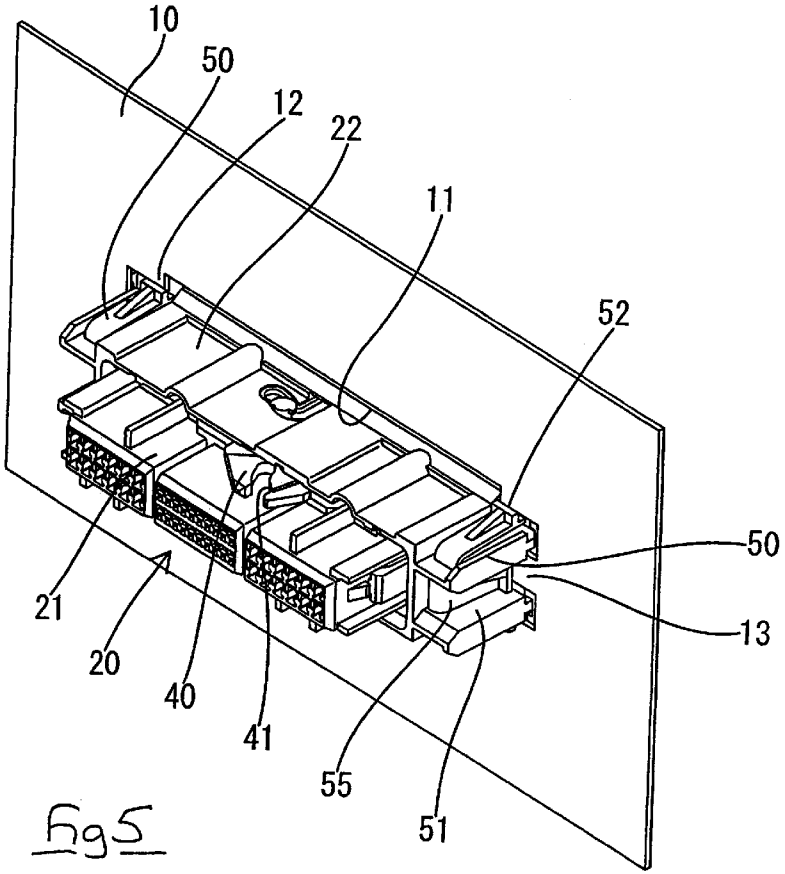
FIG. 5 is a diagonal view showing a female connector in a supported state within the panel.

As shown in FIGS. 2 and 3, the female connector 20 comprises an oblong, flat block-like connector housing 21 (hereafter referred to as female housing), and an angular tubular shaped holder 22; that houses the female housing 21.

The female housing 21 is divided into three sections in a left-right direction, each section having cavities 23 aligned therein. Female terminal fittings (not shown) are inserted from the posterior into these cavities 23.

The female housing 21 is housed by being slid into the holder 22. Although this is not shown in detail, the holder 22 can be maintained in an inserting position (see FIG. 2) whereby the majority of the female housing 21 protrudes from an anterior edge of the holder 22, and an inward position (see FIG. 9) whereby the female housing 21 is housed within the holder 22.

As shown in FIG. 2, the male connector 30 has a male connector housing 31 (hereafter referred to as male housing) comprising a base plate 32 and a hood 33 formed at an anterior face side of the base plate 32. The female housing 21 of the female connector 20 can be fitted within the hood 33 of the male housing 31, the holder 22 fitting with out sides of the hood 33.

Male terminal fittings 34 are attached to the male housing 31 in a manner whereby they pass through the base plate 32. Tips of the male terminal fittings 34 protrude into the hood 33 in locations corresponding to the cavities 23 of the female housing 21.

A pair of levers 40 are attached to upper and lower faces of the female housing 21. One side of each of these levers 40 has a cam groove 41 formed therein, these cam grooves 41 having a specified curved shape. The levers 40 are supported rotatably by axes 42 which are symmetrical above and below. A connecting pin 43 on the other side of each lever 40 fits into a connecting groove 44 of the holder 22. When the female housing 21 is maintained in the inserting position, openings 41 A of the cam grooves 41 of the two levers 40 are open towards the anterior. Follower pins 46, which are capable of fitting into the cam grooves 41 of the levers 40, protrude from upper and lower faces of the male housing 31.

When the male housing 31 is fitted to the female housing 21 that is in the inserting position, the upper and lower follower pins 46 face the openings 41A of the cam grooves 41 of the levers 40. Then, as the male housing 31 is pushed inwards, the levers 40 are rotated while the female housing 21 is pushed into the holder 22. Simultaneously, the operation between the cam grooves 41 and the follower pins 46 draws the male housing 31 towards the female housing 21. The two connectors 20 and 30 are correctly fitted together when the female housing 21 has been pushed in to the inward position.

Next, the configuration will be described whereby the female connector 20 is supported in a waiting state within the panel 10.

Figure 4:
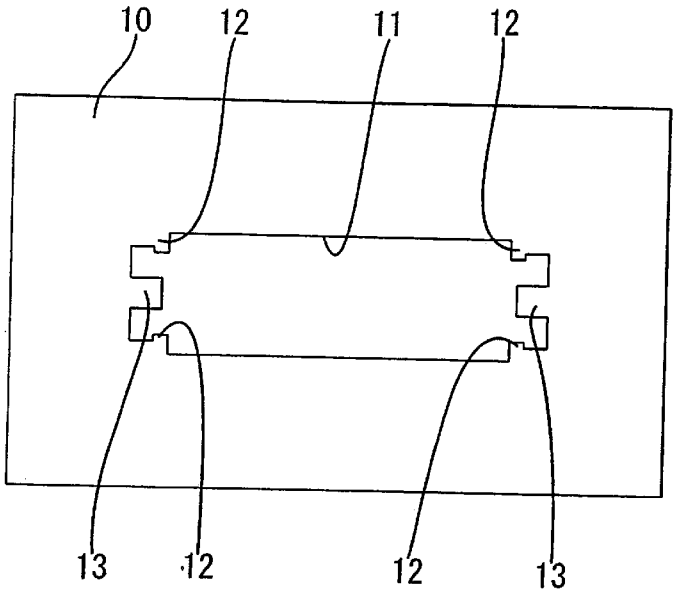
FIG. 4 is a front view of a panel.

The panel 10 has an attachment hole 11 opening therein. The female connector 20 can be inserted into this attachment hole 11 from the posterior. Flanges 25 protrude from posterior ends of left and right side faces of the holder 22 of the female connector 20. These flanges 25 make contact with left and right hole edges of inner face sides of the attachment hole 11, thereby halting the insertion of the female connector 20. As shown in FIG. 4, a retaining member 12 is formed at each of the four corners of the attachment hole 11. The retaining members 12 are formed by locating upper and lower edges of the attachment hole 11 closer to one another at the four corners, and by decreasing the width of attachment hole 11 at these four corners. Supplementary retaining members 13, which have a specified width, are located at the center (relative to the height thereof) of left and right side edges of the attachment hole 11. These supplementary retaining members 13 protrude inwards up to the location of the retaining members 12.

An upper and lower pair of vertical resilient contacts 50 is formed on each of the left and right side faces of the holder 22 (that is, there are four resilient contacts 50 in all), and one pair of horizontal resilient contacts 55 are formed on the left and right side faces of the holder 22 (that is, there are two resilient contacts 55 in all). A pair of supporting plates 51 protrude in the vicinity of upper and lower edges of the left and right side faces of the holder 22. The vertical resilient contacts 50 extend along outer face sides of these supporting plates 51 from anterior edges to posterior edges of the holder 22. Posterior ends of the vertical resilient contacts 50 bend away from the supporting plates 51. Contacting plates 52 are formed along the entire width of outer faces of the tip of each vertical resilient contact 50. These contacting plates 52 make contact with outer faces of the retaining members 12 of the attachment hole 11. A rib 53 is formed at an approximately central location (relative to the widthwise direction) of an inner face side of each contacting plate 52. A spine of each rib 53 becomes gradually lower as it approaches a base end of each vertical resilient contact 50.

The pair of horizontal resilient contacts 55, which are formed on the left and right side faces of the holder 22 between the upper and lower pairs of supporting plates 51, also extend from the anterior edges to the posterior edges of the holder 22, and posterior ends of these horizontal resilient contacts 55 bend away from the side faces of the holder 22. Contacting plates 56 are formed along the entire width of an outer face of a tip of each horizontal resilient contact 55. These contacting plates 56 make contact with outer faces of the supplementary retaining members 13 of the attachment hole 11. A rib 57 is formed at an approximately central location (relative to the widthwise direction) of an inner face side of each contacting plate 56. A spine of each rib 57 becomes gradually lower as it approaches a base end of each horizontal resilient contact 55.

As the female connector 20 is pushed inwards from the posterior into the attachment hole 11 of the panel 10, the ribs 53 of the left and right pairs of vertical resilient contacts 50 make contact with protruding edges of the corresponding retaining members 12, this causing the vertical resilient contacts 50 to bend. Further, the ribs 57 of the horizontal resilient contacts 55 at the left and right of the female connector 20 make contact with protruding edges of the corresponding supplementary retaining members 13, this causing the horizontal resilient contacts 55 to bend. Next, the flanges 25 of the holder 22 make contact with the hole edges of the inner sides of the attachment hole 11, the contacting plates 52 of the vertical resilient contacts 50 move past the retaining members 12, then the vertical resilient contacts 50 return resiliently to their original shape and the contacting plates 52 make contact with the outer faces of the retaining members 12. Furthermore, the contacting plates 56 of the horizontal resilient contacts 55 move past the supplementary retaining members 13, then the horizontal resilient contacts 55 return resiliently to their original shape and the contacting plates 56 make contact with the outer faces of the supplementary retaining members 13.

By this means, the female connector 20 is supported within the panel 10 in a state whereby it cannot be removed towards the anterior or the posterior, and in which the vertical resilient contacts 50 and the horizontal resilient contacts 55 are capable of moving resiliently to allow the female connector 20 to be moved within the attachment hole 11 along the plate face of the panel 10.

Contacting faces 52A of the contacting plates 52 of the vertical resilient contacts 50 and contacting faces 56A of the contacting plates 56 of the horizontal resilient contacts 55 are formed as tapered faces whose protruding ends retreat gradually towards their inner sides.

Figure 7:
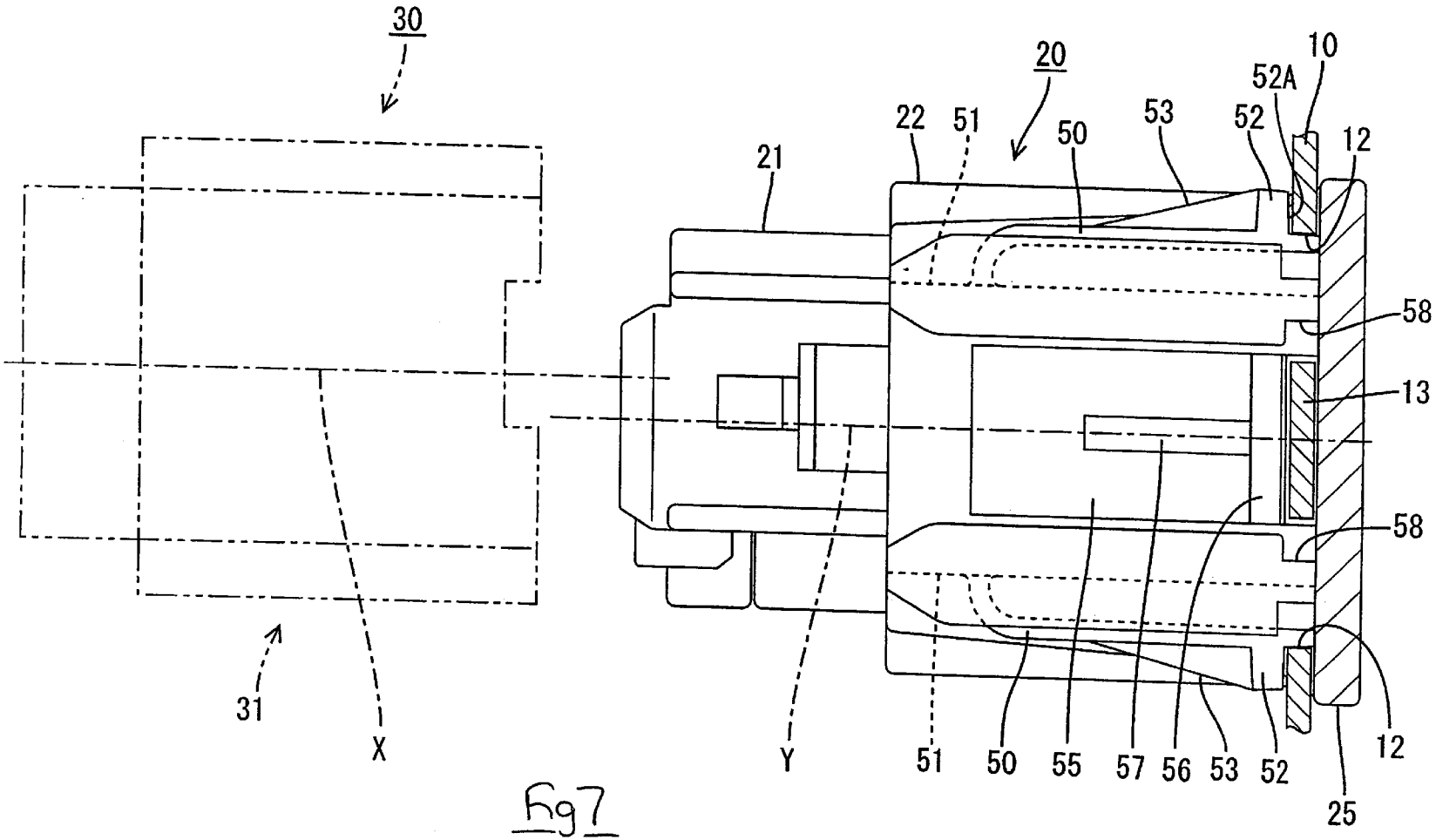
FIG. 7 is a partially cut-away side face view of the above.

The upper and lower supporting plates 51 (which have the horizontal resilient contacts 55 formed thereon) have a thickness sufficient to reach the immediate vicinity of the upper or lower edges of the supplementary retaining members 13 when the female connector 20 is first supported in the panel 10 (see FIG. 7). Stopping grooves 58, which are formed by cutting away, are provided in posterior ends of mutually opposing upper and lower faces of the upper and lower supporting plates 51. These stopping grooves 58 have a width approximately the same as the thickness of the panel 10. The depth of these stopping grooves 58 is approximately the same as the greatest bending capacity of the vertical resilient contacts 50.

The present embodiment is configured as described above. Next, the operation thereof will be described.

As shown in FIGS. 2 and 3, the female housing 21 of the female connector 20 is first housed in the inserting position within the holder 22. Then, the female connector 20 is inserted from the innermost face side into the attachment hole 11 of the panel 10 (as shown by the arrow in FIG. 2). As the female connector 20 is pushed inwards, the left and right pairs of vertical resilient contacts 50 bend by making contact with the protruding edges of the corresponding retaining members 12. The left and right horizontal resilient contacts 55 bend by making contact with the protruding edges of the corresponding supplementary retaining members 13. After the flanges 25 have made contact with the hole edges of the inner sides of the attachment hole 11, the vertical resilient contacts 50 return resiliently to their original shape and the contacting plates 52 thereof make contact with the outer faces of the retaining members 12. The horizontal resilient contacts 55 also return resiliently to their original shape and the contacting plates 56 thereof make contact with the outer faces of the supplementary retaining members 13 (see FIGS. 5 to 7). The female connector 20 is now supported in the panel 10 in a state whereby it cannot be removed towards the anterior or the posterior, although it can be moved resiliently along the plate face of the panel 10.

The inner face sides of the contacting plates 52 and 56 are respectively provided with the ribs 53 and 57, whose spines become gradually lower. The protruding edges of the retaining members 12 and the supplementary retaining members 13 respectively slide along the lower edges of the ribs 53 and 57, this causing the vertical resilient contacts 50 and the horizontal resilient contacts 55 to bend smoothly. That is, the ribs 53 and 57 have the function of guiding the resilient contacts 50 and 55 when they bend, as well as the function of strengthening the contacting plates 52 and 56. Moreover, the contacting faces 52A of the contacting plates 52 of the vertical resilient contacts 50 and the contacting faces 56A of the contacting plates 56 of the horizontal resilient contacts 55 are formed as tapered faces whose protruding ends retreat gradually towards their inner sides. Consequently, when the contacting plates 52 and 56 respectively move past the retaining members 12 and the supplementary retaining members 13, and the resilient contacts 50 and 55 return to their original positions, the protruding ends of the contacting faces 52A and 56A prevent the plate faces of the retaining members 12 and the supplementary retaining members 13 from engaging with the resilient contacts 50 and 55, thereby allowing these resilient contacts 50 and 55 to return smoothly to their original positions.

Figure 6:
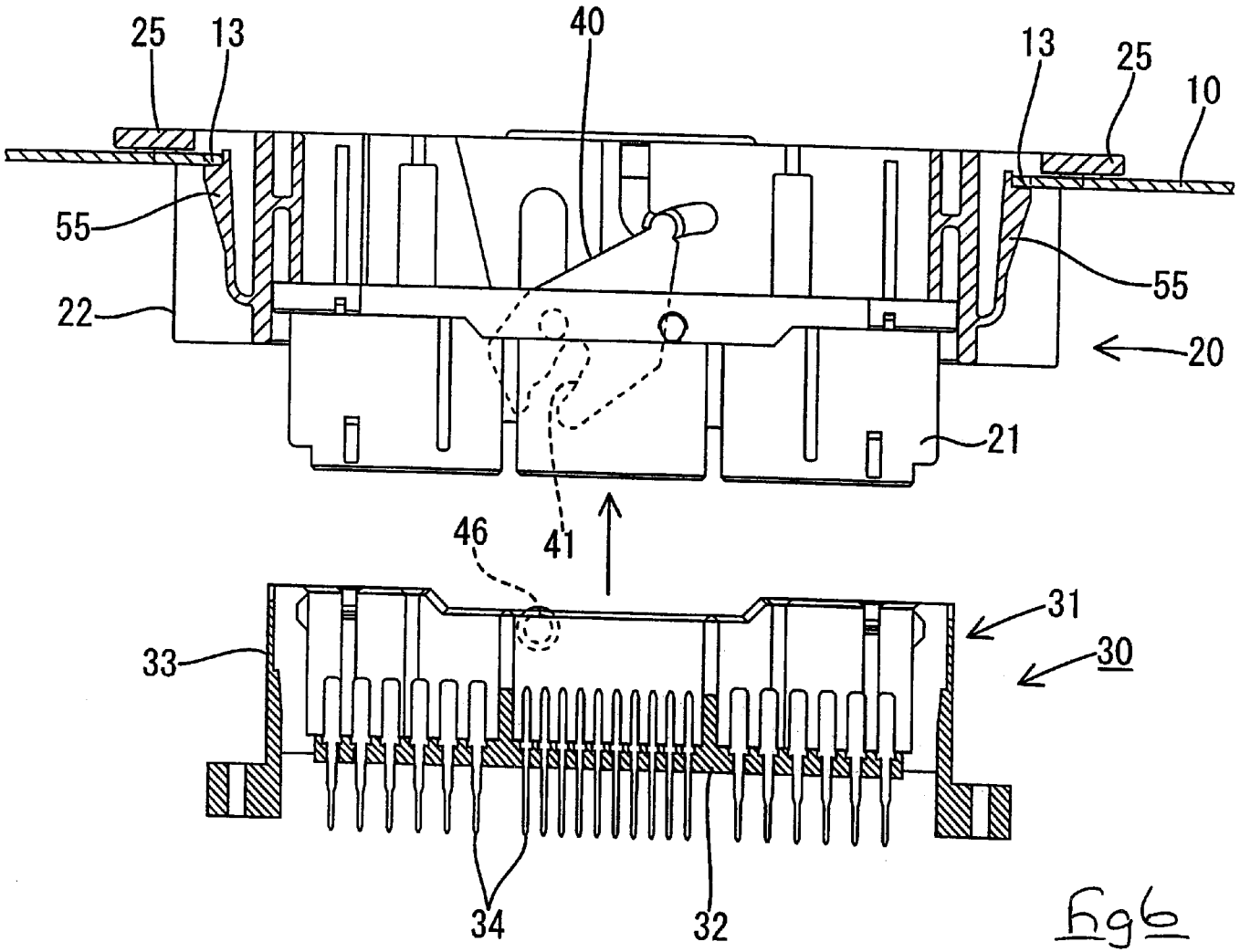
FIG. 6 is a plan cross-sectional view showing a corresponding male connector prior to fitting.

When the female connector 20 is supported in the panel 10 in the waiting state as described above, the male connector 30 is fitted to the female connector 20 from the anterior thereof (shown by the arrow in FIG. 6). It is possible that the axes of the female and male connectors 20 and 30 may be misaligned. If, as shown in FIG. 7, an axis X of the male connector 30 is misaligned so as to be above an axis Y of the female connector 20, when anterior ends of the hood 33 of the male housing 31 and the female housing 21 have made contact, the upper vertical resilient contacts 50 (of the upper and lower pairs of vertical resilient contacts 50) bend (see FIG. 8), thus moving the female connector 20 upwards and aligning the axes of the two connectors 20 and 30.

Figure 8:
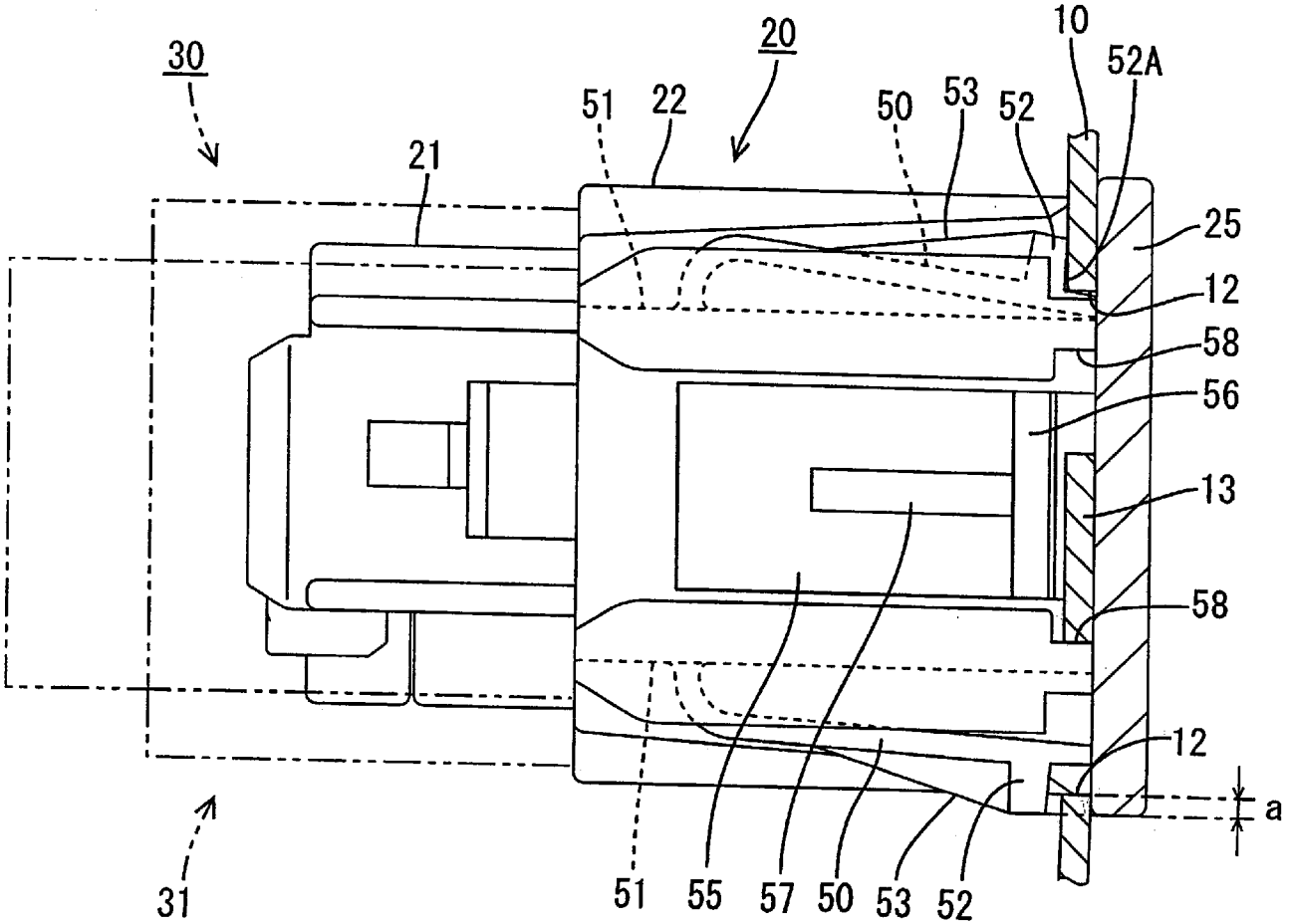
FIG. 8 is a partially cut-away side face view showing axes of the two connectors after they have been aligned.
Figure 9:
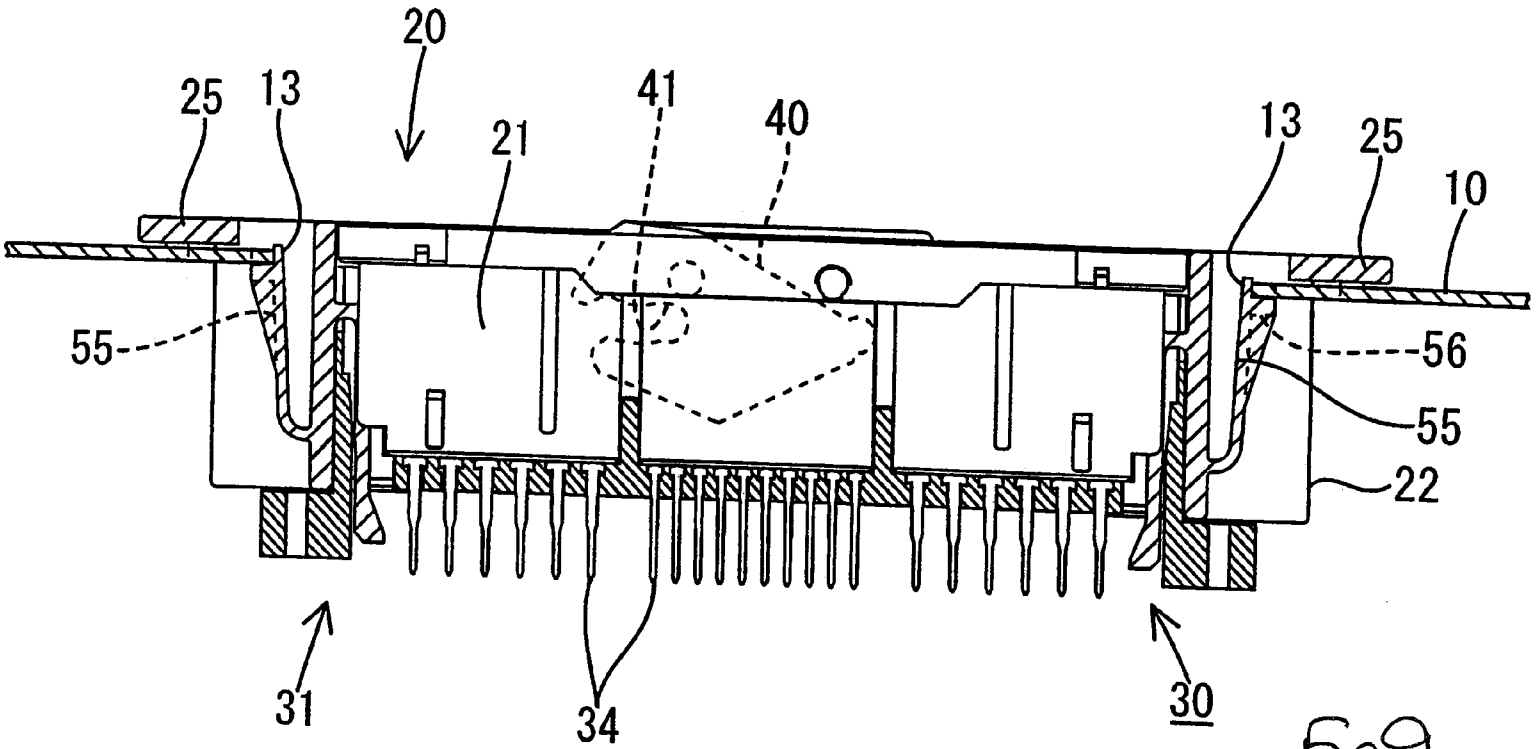
FIG. 9 is a plan cross-sectional view showing the female and male connectors in a correctly fitted state.

As the female connector 20 moves upwards, tips of the lower vertical resilient contacts 50 rise away from the protruding edges of the retaining members 12, the degree of engagement between the contacting plates 52 and the retaining members 12 thereby being reduced (this is shown by the letter a in FIG. 8). However, the reduction in the degree of engagement between the contacting plates 52 of the lower vertical resilient contacts 50 and the retaining members 12 is compensated for by the lower edges of the supplementary retaining members 13 entering, by a corresponding depth, the lower stopping grooves 58.

If the male connector 30 is pushed in when the two connectors 20 and 30 are in a state whereby their axes have been aligned, the upper and lower follower pins 46 of the male housing 31 face the openings 41 A of the cam grooves 41 of the levers 40. The female housing 21 is pushed into the holder 22 as the levers 40 are pivoted, the operation between the cam grooves 41 and the follower pins 46 simultaneously drawing the male housing 31 towards the female housing 21. In this manner, the two connectors 20 and 30 are correctly fitted together.

During this process, the female connector 20 receives a pushing force from the male connector 30. However, since the reduction in the degree of engagement thereof is compensated for, the male connector 30 does not leave the attachment hole 11. Furthermore, the contacting faces 52 A of the contacting plates 52 of the vertical resilient contacts 50 are formed as tapered faces. Consequently, when the resilient contacts 50 bend, the entirety of these contacting faces 52A make contact with the retaining members 12, thereby allowing a large retaining force to be attained.

If, in the case opposite to that described earlier, the axis X of the male connector 30 is misaligned so as to be below the axis Y of the female connector 20, the lower vertical resilient contacts 50 bend, thus moving the female connector 20 downwards and aligning the axes of the two connectors 20 and 30. At this juncture, the degree of engagement between the contacting plates 52 of the upper vertical resilient contacts 50 and the retaining members 12 is reduced. However, the reduction in the degree of engagement between the contacting plates 52 of the upper vertical resilient contacts 50 and the retaining members 12 is compensated for by the upper edges of the supplementary retaining members 13 entering, by a corresponding depth, the upper stopping grooves 58.

In the case where the axis X of the male connector 30 is misaligned in a left or right direction relative to the axis Y of the female connector 20, the left or right horizontal resilient contacts 55 bend, thus moving the female connector 20 in their direction of bending and aligning the axes of the two connectors 20 and 30. At this juncture, the degree of engagement between the contacting plate 56 of the horizontal resilient contact 55 (of the side which did not bend) and the supplementary retaining members 13 is reduced. However, since the vertical resilient contacts 50 are provided in two locations above and below the horizontal resilient contacts 55, the degree of engagement is not significantly affected.

The present invention is not limited to the embodiments described above with the aid of figures. For example, the possibilities described below also lie within the technical range of the present invention. In addition, the present invention may be embodied in various other ways without deviating from the scope thereof.

(1) The present embodiment may also be used as a configuration which compensates for the reduction in the degree of engagement on the side provided with the horizontal resilient contacts.

(2) The present invention is equally suitable for the case where the waiting connector is the male connector.

(3) The present invention is equally suitable for a regular connector which does not employ a lever to assist the fitting operation.

What is claimed is:

1. In combination, a connector and a panel having an aperture to receive said connector with clearance, said connector having resilient external contacts for engagement with a periphery of said aperture whereby said connector is retained in said aperture for limited movement in a plane of said panel and a support structure forming an inner surface along each of the opposite sides of the connector generally facing toward the aperture, wherein at least two of the resilient contacts are formed on each of said opposite sides of said connector, and the at least two resilient contacts on each of the opposite sides are deformable in opposite directions, wherein said panel further comprises inward protrusions of said aperture which respectively project into the aperture between associated pairs of said resilient contacts, and wherein said resilient contacts engage the opposite sides of said aperture such that partial disengagement of the respective resilient contact from said periphery of the aperture, as a result of lateral movement of said connector in said aperture, causes the inner surface of the one of the support structures to engage one of said protrusions by an amount generally corresponding to the amount of partial disengagement of the resilient contact.

2. The combination of claim 1 wherein support structure includes opposite grooves adjacent said resilient contacts and for engagement with a respective protrusion.

3. The combination according to claim 1 wherein said connector further includes opposite resilient members located one each between a respective pair of resilient contacts and deformable at right angles thereto, said opposite resilient members being engageable with an inner edge of said protrusion.

4. The combination of claim 1 wherein said connector comprises a housing having cavities to receive electrical terminals, and a tubular holder to receive said housing, and wherein said resilient contacts are provided on said holder.

5. The combination of claim 4 wherein said housing is slidable through said holder from a non-protruding to a protruding position.

6. The combination of claim 5 wherein said housing is latchable with said holder in the protruding condition.

7. The combination of claim 1 wherein said resilient contacts comprise cantilevered arms extending in a direction opposite to the direction of insertion of said connector in said aperture, each of said arms having an abutment for engagement with the periphery of said aperture on the side opposite to said direction of insertion.

8. The combination of claim 7 wherein each abutment is defined by a step of a respective cantilevered arm.

9. The combination of claim 7 wherein said abutments protrude substantially transversely to said direction of insertion, a respective rib extending from the outer edge of each abutment towards the root of the respective cantilevered arm, thereby to provide a ramp for engagement with the periphery of said aperture.

10. The combination of claim 7 wherein for each abutment, the side opposite to a respective rib is tapered with respect to the plane of said panel, in use the outermost part of said side being further from said panel than the innermost part in the free condition of the respective arm.

11. The combination of claim 9 wherein for each abutment, the side opposite to a respective rib is tapered with respect to the plane of said panel, in use the outermost part of said side being further from said panel than the innermost part in the free condition of the respective arm.

12. The combination of claim 9 wherein each abutment is defined by a step of a respective cantilevered arm.

13. The combination of claim 10 wherein each abutment is defined by a step of a respective cantilevered arm.

14. In combination, a connector and a panel having an aperture to receive said connector with clearance, said connector having resilient external contacts for engagement with the periphery of said aperture whereby said connector is retained in said aperture for limited movement in the plane of said panel, wherein opposite sides of said connector each have a pair of said resilient contacts, each pair of resilient contacts engaging opposite sides of the periphery and being oppositely deformable to apply opposite biasing forces in directions generally parallel to the aperture to position the connector in the aperture, and said panel further comprises inward protrusions of said aperture which respectively project between associated pairs of said resilient contacts, wherein partial disengagement of a respective resilient contact from the periphery of said aperture, as a result of lateral movement of said connector in said aperture, causes a corresponding support structure to engage said protrusion by an amount corresponding to the partial disengagement of the resilient contact from the periphery of the, said support structure including opposite grooves adjacent said resilient contacts for engagement with the periphery of said panel and a respective protrusion, and said connector comprising a housing having cavities to receive electrical terminals, and a tubular holder to receive said housing, said resilient contacts being provided on said holder.

* * * * *